US012227275B2

(12) United States Patent
Hegyi

(10) Patent No.: US 12,227,275 B2
(45) Date of Patent: Feb. 18, 2025

(54) SELF-INFLATING WATER RESCUE DEVICE

(71) Applicant: Akos Balazs Hegyi, Budapest (HU)

(72) Inventor: Akos Balazs Hegyi, Budapest (HU)

( * ) Notice: Subject to any disclaimer, the term of this patent is extended or adjusted under 35 U.S.C. 154(b) by 32 days.

(21) Appl. No.: 17/567,132

(22) Filed: Jan. 2, 2022

(65) Prior Publication Data

US 2023/0211860 A1 Jul. 6, 2023

(51) Int. Cl.
*B63C 9/15* (2006.01)
*B63C 9/18* (2006.01)

(52) U.S. Cl.
CPC ..... *B63C 9/155* (2013.01); *B63C 9/18* (2013.01)

(58) Field of Classification Search
CPC ..... B63C 9/155; B63C 9/18; B63B 34/52
See application file for complete search history.

(56) References Cited

U.S. PATENT DOCUMENTS 5,702,279 A * 12/1997 Brown ..... B63C 9/155 441/108

FOREIGN PATENT DOCUMENTS

GB 771575 A * 10/1954

* cited by examiner

*Primary Examiner* — Andrew Polay

(57) ABSTRACT

A self-inflating water rescue device (1) consisting of a belt (2) for fastening to the waist and a lifebelt (5) connected to a compressed gas cartridge (4) attached to an opening trigger (3), the belt (2) and the lifebelt (5) being connected to each other by a safety strap (9), one end of a release cord (11) is connected to the opening trigger (3), the other end of the cord (11) being routed outside the lifesaving device (1), the lifebelt (5) being provided with a release valve (12) where applicable, and characterized by that a storage pocket (8) is formed on at least a part of the outer side of the belt (2) by a fixed wall (6) and an sliding (loose) wall (7), the lifebelt (5) being arranged in the storage pocket (case) (8), the outer part of the belt (2) being itself a fixed wall (6) of the pocket (8), the lifebelt (5) has a basically interrupted perimeter circle shape, the ends (13) of which at the interruption are overlapping when filled with gas, and when not filled with gas the lifebelt (5) is folded into the pocket (8) in an accordion/fan-like manner.

3 Claims, 8 Drawing Sheets

SELF-INFLATING WATER RESCUE DEVICE

BACKGROUND

Prior Art

Life belts can be categorized into two groups: one of them is the group of swimming aids, which are basically sportswear that facilitates movement in water, the other is the group of water rescue equipment.

Fixed buoyancy swim belts are designed for specific purposes-usually to keep a person afloat in un upright position, but separate types had to be constructed for specific tasks. The invention of the American FREEDOM FLOAT crossed a diving buoy with a belt. The result is a cylinder inflatable tube that can be worn on a belt, and in case of danger, the tube can be inflated using a panic cord.

As development progressed, swim vests became available, even before World War I. It was discovered early in the developmental process that the structure of swim vests is pivotal, as they need to hold an unconscious body on the surface of the water with the face being considerably higher than the surface itself. This needed a specific construction which turned the unconscious person face-up. Compared to swim vests, considerably more buoyancy was needed to effectively achieve the so-called buoy effect. Swim vests and life vests are not the same. Their purpose is different. In the case of swim vests, turning the face is not important, just as effectiveness, i.e., keeping the body too high, is not important either. However, with life vests, maintaining buoyancy in any circumstance is of utmost importance. Swim vests need to control buoyancy, often from zero. Older life vests-because they neglected turning the face-could only function as swim vests, even though they were used in different instances. Therefore, they became the cause of numerous unfortunate accidents. The production of traditional inflatable life vests has seen an incline recently. In many cases, life vests are used during the teaching of swimming, which is a faulty method.

Traditional vests are inflated using a CO2 cylinder when submerged, which can be activated by a water-sensitive mechanism. While user-activated vests are fitted with a panic cord that activates the inflation mechanism when pulled. The inflation itself is very quick, and usually takes approximately 2-5 seconds. If we use this method to inflate a vest that was originally made to be a life vest, it will turn its user face up on the surface. If we inflate it partially, at 10% of its overall capacity, either by using our mouth or a nominally smaller CO2 cylinder (e.g., half a load), it can be used as a swim vest as well. Note that the latter method may not provide sufficient buoyancy. Another problem is caused by the fact that, while inflating may be easy, deflating most life vests requires two hands and a pointed object pressing the valve, which makes this kind of use troublesome.

U.S. Pat. No. 3,952,355 describes an inflatable rescue appliance consisting of an elongated, straight inflatable part and a fixture which is attached to the inflatable part and encircles the wrist of the wearer. The actuator is attached to a gas generator in or adjacent to the inflatable part so that, during the operation of the actuator, a certain amount of gas flows into the inflatable part to inflate it, providing buoyancy to the wearer. The fixture exposes the ends of the inflatable part and allows it to inflate. The disadvantage of this design is that it does not ensure that the wearer's head is lifted out of the water. Due to the fixed position, it is doubtful whether not only the wearer's waist, but their head is also lifted above the water, and whether the wearer is turned over to their back at all.

U.S. Pat. No. 5,702,279 describes a life-saving inflatable safety belt. The first belt is effectively hollow and is fastened around the waist. In this case, it is filled with compressed gas from an attached cartridge so that it extends and opens when being filled with the compressed gas. As per the invention, the second belt is fastened at the bottom of the waist, below the first belt, in the conventional construction. When compressed gas flows into the first belt, its length increases, becomes tubular and pops under the armpit to hold the wearer vertically in the water, as a life-saving device, allowing the wearer to swim with the device. The front belt is attached to the belt around the waist. After inflation, the strap connecting both ends of the belt allows the first belt to rise under the arms of the person who is submerged in the water, or eve up to the neck if the shoulders are tucked under it. With this solution, the strap connecting the ends of the front belt must be adjusted very precisely so that it can rise to the correct position. If the wearer's abdominal circumference exceeds the circumference of the upper body, the wearer can easily slip out of it, especially if they "panic". If the front belt cannot rise because the strap is too tight, it raises the waist of the person in the water, causing them to turn face down into the water. By tying the ends together with an elastic strap, the level of elasticity must ensure that it is not too stretchy in case of a thinner body, but at the same time can be stretched to a suitable size in case of a thicker body. At the same time, this solution has the first belt comprised of separate parts (pieces, items) that are typically connected at the face or abdomen, therefore there is a lack of continuity in the rescue device exactly where it is most needed, i.e., to lift the head or the face out of the water. This solution is also a swimming aid, e.g., for swimming lessons. It has been proven that it is not advisable to use the same design for a life saving device and a swimming aid. This results in an instrument that is good for everything, but not perfect for anything. Moreover, the device is designed with an excessive belt, which not only adds weight but also reduces comfort.

SUMMARY OF THE INVENTION

The purpose of our model is to make previously known water rescue devices safer and more usable, i.e., to develop a rescue device and not a swimming aid. It has now been found that if the belt is shaped such that it surrounds the body like a pair of scissors or pliers with protruding ends, the device can greatly adapt to the circumference of the body. Attachment to the waist with the second belt can provide fastening of the life belt to the wearer in a known manner. In addition, we can clearly position the life belt under the armpit to ensure that the wearer is in a properly secure posture after falling into the water without them having to do anything. Therefore, it is clearly suitable for keeping a person in the water on the surface.

Our model thus consists of a self-inflating water rescue device, consisting of a waist-belt and a life belt connected to a pressurized gas cylinder attached to an opening device. On at least one part of the outer wall of the belt, there is a storage pocket (case) formed by a fix wall and a loose, sliding wall, the former of which is the outer wall of the belt itself. The life belt is arranged in the storage case, and the belt and the life belt are connected to each other by a safety strap. A release cord is connected to the opening device on one end, the other end it is placed outside the water rescue device.

The life belt is also provided with a release valve. Essentially, the life belt has a substantially interrupted circumferential shape, the ends of which are overlapping at the interruption—in the gas-filled state—and folded into the case much like in the shape of an accordion/fan when the life belt is gas-free.

Some characteristic advantages of our model are described in the claims and some characteristic advantages are shown in the figures.

DESCRIPTION

Summary of the Invention

The purpose of the model is to make previously known water rescue devices safer and more usable, i.e., to develop a rescue device and not a swimming aid. It has now been found that if the belt is shaped such that it surrounds the body like a pair of scissors or pliers with protruding ends, the device can greatly adapt to the circumference of the body. Attachment to the waist with the second belt can provide fastening of the life belt to the wearer in a known manner. In addition, we can clearly position the life belt under the armpit to ensure that the wearer is in a properly secure posture after falling into the water without them having to do anything. Therefore, it is clearly suitable for keeping a person in the water on the surface.

The model consists of a self-inflating water rescue device, consisting of a waistbelt and a life belt connected to a pressurized gas cylinder attached to an opening device. On at least one part of the outer wall of the belt, there is a storage pocket (case) formed by a fix wall and a loose, sliding wall, the former of which is the outer wall of the belt itself. The life belt is arranged in the storage case, and the belt and the life belt are connected to each other by a safety strap. A release cord is connected to the opening device on one end, the other end it is placed outside the water rescue device. The life belt is also provided with a release valve. Essentially, the life belt has a substantially interrupted circumferential shape, the ends of which are overlapping at the interruption—in the gas-filled state—and folded into the case much like in the shape of an accordion/fan when the life belt is gas-free.

DETAILED DESCRIPTION

Figure 1:
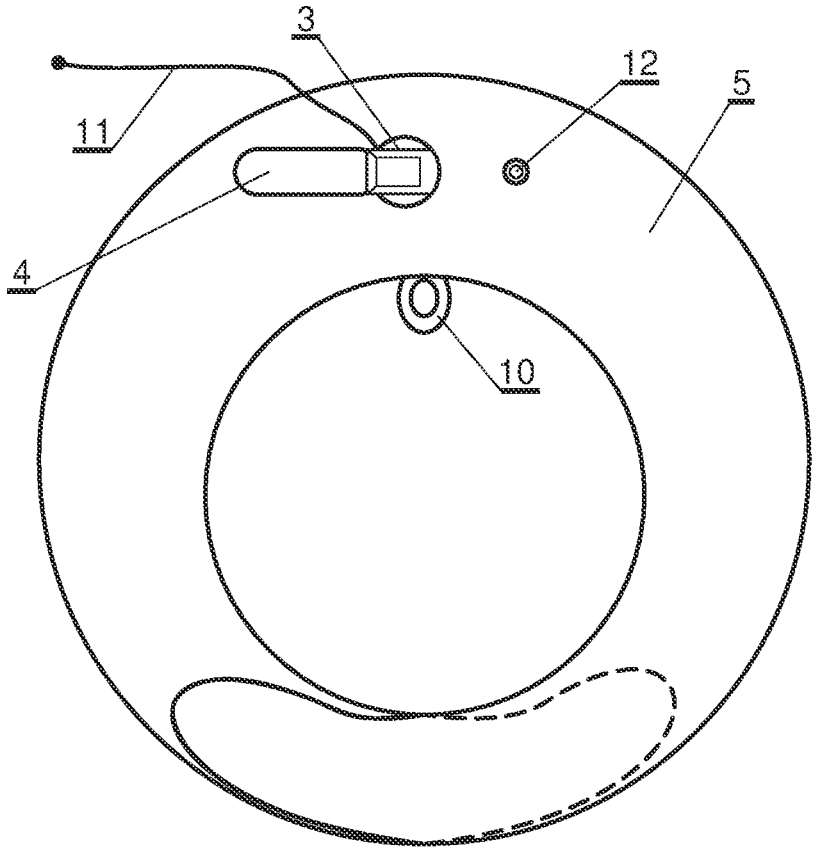
FIG. 1 shows the active, inflated state of the life belt in top/bottom view.
Figure 2:
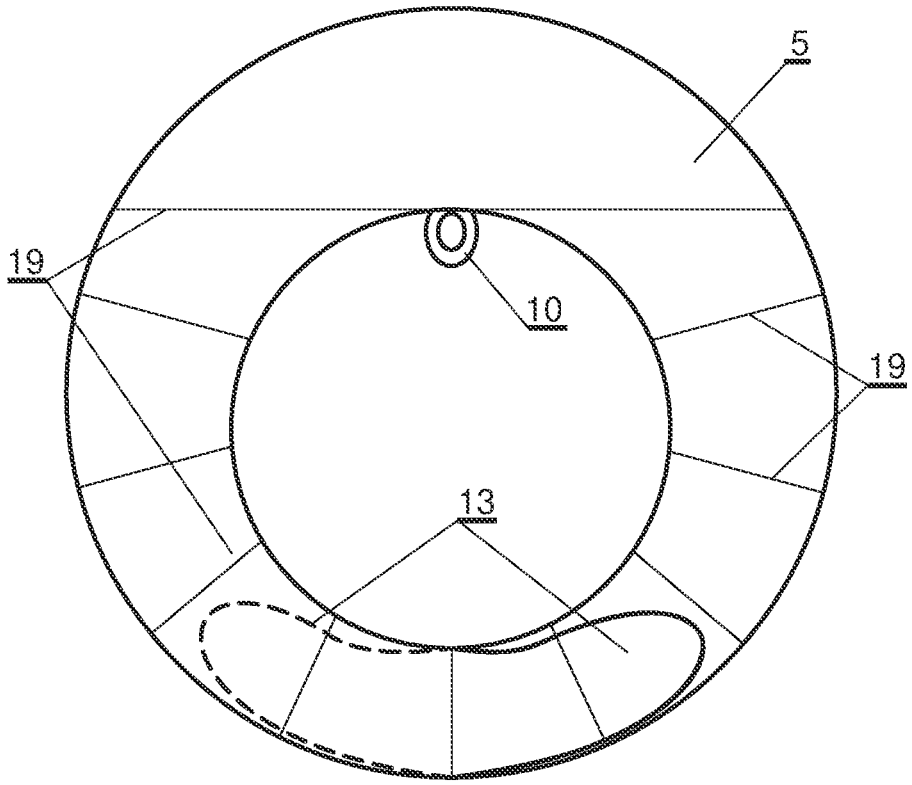
FIG. 2 shows the active inflated state of the life belt in top/bottom view, with the fold lines indicated.
Figure 3:
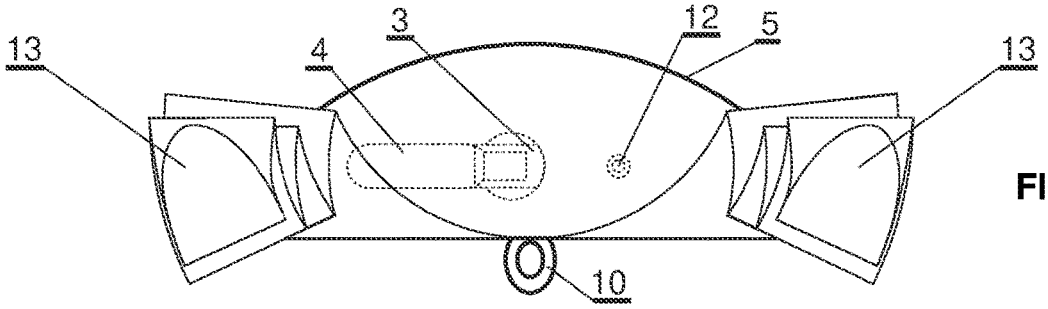
FIG. 3 is a top plan view of an example for folding a gas-free, deflated life belt to place it into the case.
Figure 4:
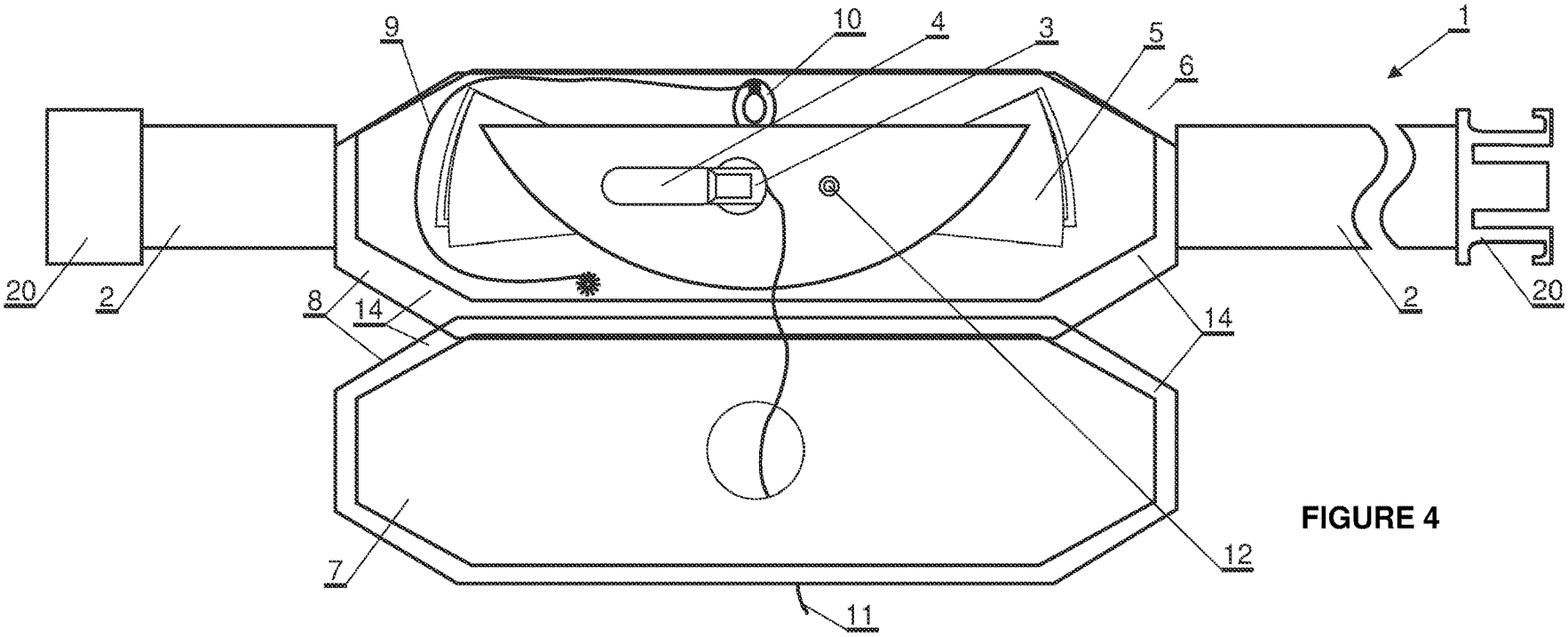
FIG. 4 is a front view of the belt with its pocket (case) open.
Figure 5:
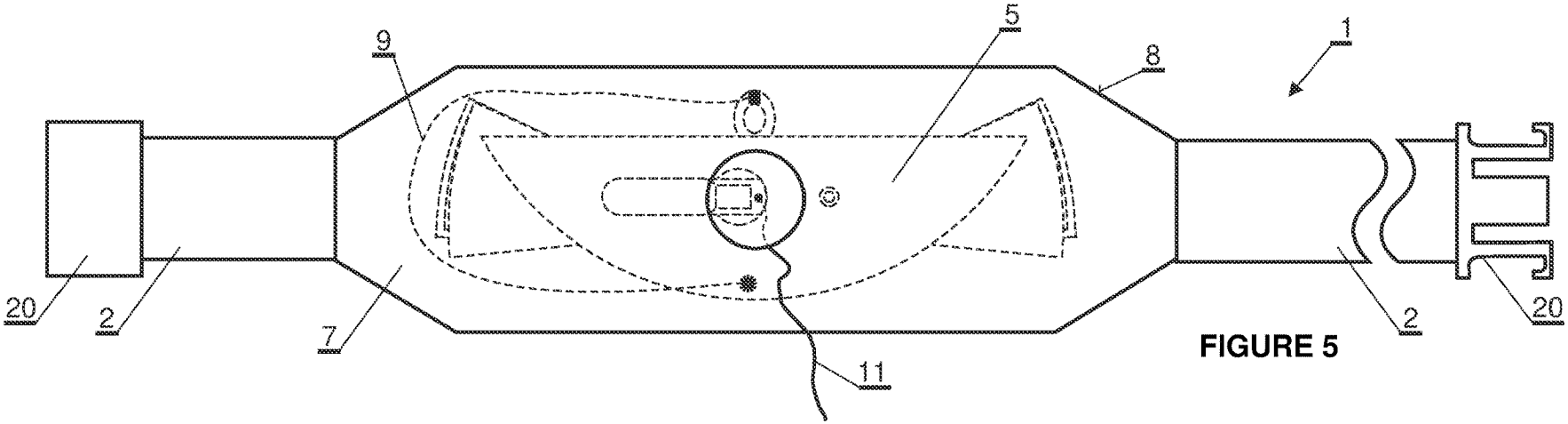
FIG. 5 is a front view of a ready-to-use life belt.
Figure 6:
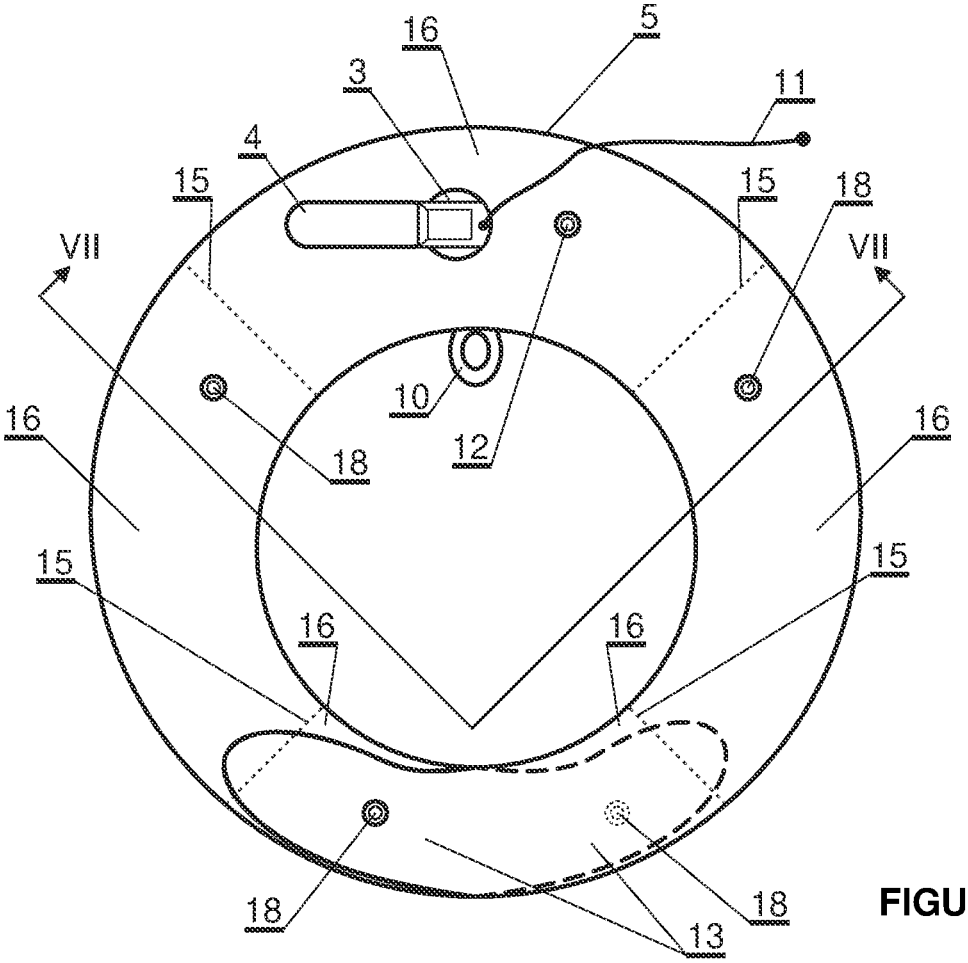
FIG. 6 is a top plan view of a life belt and its compartments, with the inner dividing walls marked with a dashed line.
Figure 7:
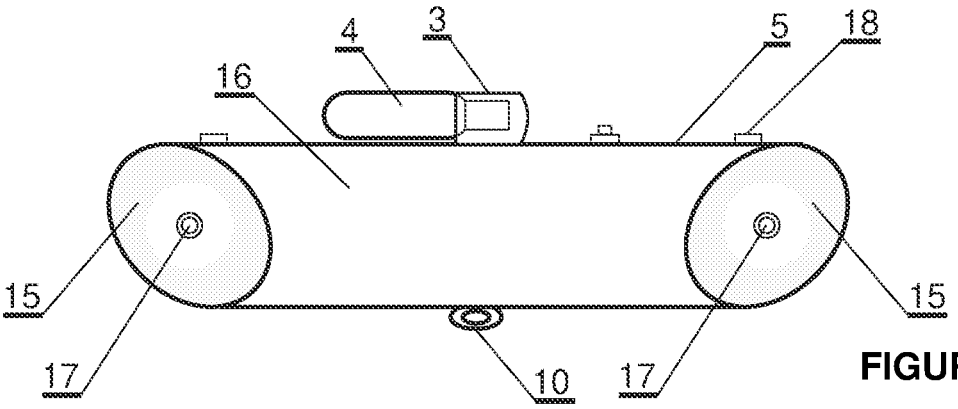
FIG. 7 is a side elevation view of sections VII-VII of the life belt on FIG. 6.
Figure 8:
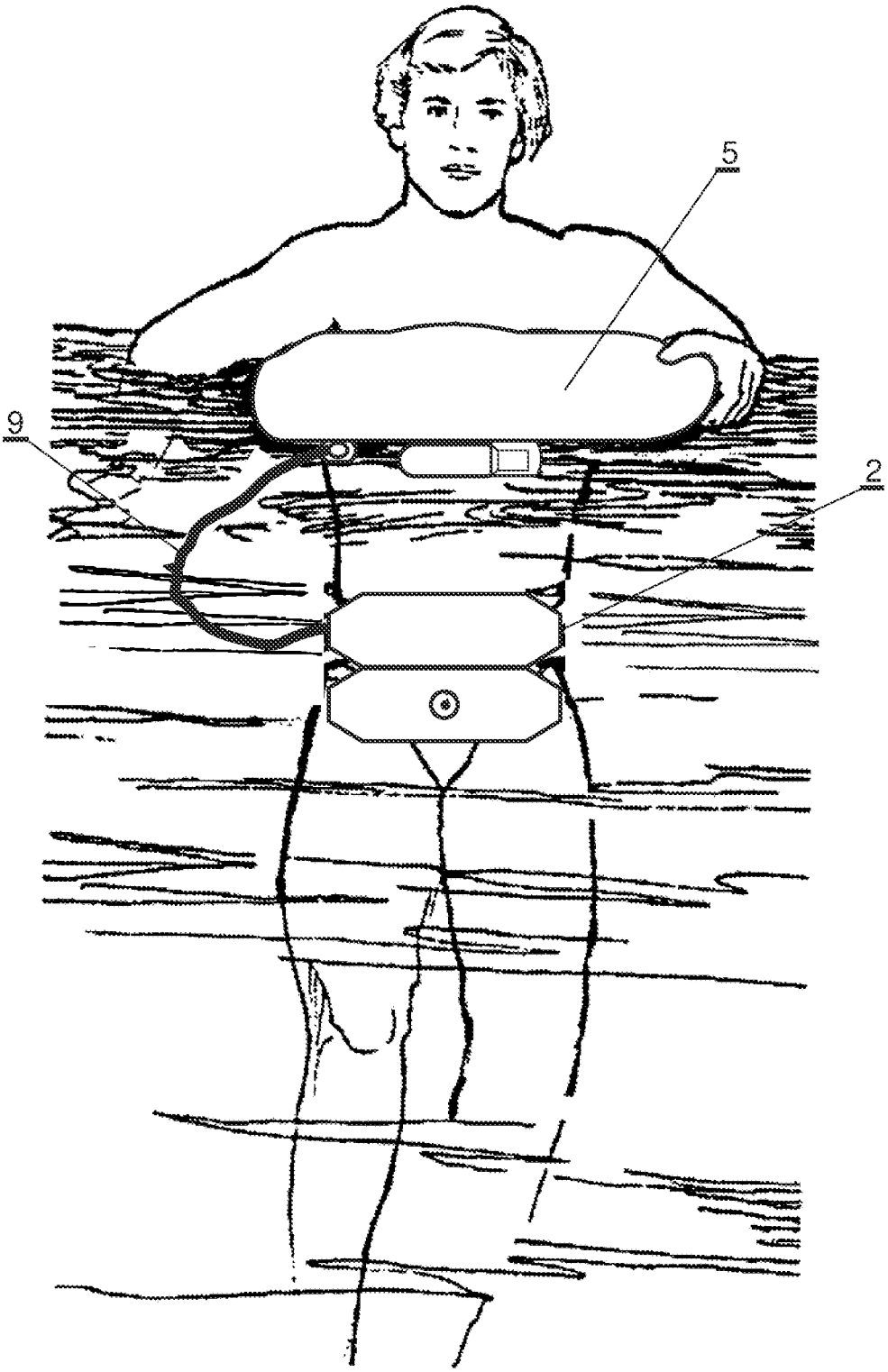
FIG. 8 is a front view of the lifeguard appliance in use.

A self-inflating water rescue device (1) consisting of a belt (2) for fastening to the waist and a lifebelt (5) connected to a compressed gas cartridge (4) attached to an opening trigger (3), the belt (2) and the lifebelt (5) being connected to each other by a safety strap (9), one end of a release cord (11) is connected to the opening trigger (3), the other end of the cord (11) being routed outside the lifesaving device (1), the lifebelt (5) being provided with a release valve (12) where applicable, and characterized by that a storage pocket (8) is formed on at least a part of the outer side of the belt (2) by a fixed wall (6) and an sliding (loose) wall (7), the lifebelt (5) being arranged in the storage pocket (case) (8), the outer part of the belt (2) being if a fixed well (6) of the pocket (8) the lifebelt (5) has a basically interrupted perimeter circle shape, the ends (13) of which at the interruption are overlapping when filed with gas, and when not filed w h s the lifebelt (5) is folded into the pocket (8) in an accordion/fan-like manner.

The invention claimed is:

1. A self-inflating water secure device, comprising of a belt configured to be secured to the waist, the belt comprises a top surface and a bottom surface, and the belt connected to a pressurized gas cylinder attached to an opening device, on at least one part of the outer wall of the belt, there is a storage pocket formed by a fixed wall and a loose, sliding wall, the former of which is the outer wall of the belt itself, the belt is arranged in the storage case, and the belt and the belt are connected to each other by a safety strap, characterized in that the cross-section of the belt is the smallest at the ends, is continuously increasing in size from the ends towards the middle, and is the largest at the same distance from the ends, the discharge valve is designed to be a human-powered valve also suitable for air injection;

wherein the pressurized gas cylinder and the human-powered valve are located on the top surface of the outer wall on the belt on a opposite half of the belt from the smallest ends.

2. The device according to claim 1, characterized in that the loose opening wall of the storage pocket is closed with a hook and loop fastener to the fixed wall.

3. The device according to any one of claim 1, characterized in that the life belt is provided with compartments partitioned by internal divider walls, in which fill valves are installed, while discharge valves are integrated into the outer peripheral edges of the compartments.

* * * * *